US011377288B1

(12) United States Patent
Oppenheim

(10) Patent No.: US 11,377,288 B1
(45) Date of Patent: Jul. 5, 2022

(54) PORTABLE CORDLESS FAN CARRYING CASE

(71) Applicant: Matthew J. Oppenheim, Collierville, TN (US)

(72) Inventor: Matthew J. Oppenheim, Collierville, TN (US)

(73) Assignee: Meko Outdoors Inc., Collierville, TN (US)

( * ) Notice: Subject to any disclaimer, the term of this patent is extended or adjusted under 35 U.S.C. 154(b) by 0 days.

(21) Appl. No.: 16/792,189

(22) Filed: Feb. 15, 2020

(51) Int. Cl.
*B65D 81/05* (2006.01)
*B65B 5/06* (2006.01)
*B65D 85/68* (2006.01)

(52) U.S. Cl.
CPC ..... *B65D 81/05* (2013.01); *B65B 5/06* (2013.01); *B65D 85/68* (2013.01); *B65D 2585/6807* (2013.01)

(58) Field of Classification Search
CPC ..... B65D 81/05; B65D 85/68; B65D 2585/6807; B65B 5/06
USPC ..... 206/207, 223, 564, 349, 557, 320, 488, 206/446; 220/4.22, 4.24
See application file for complete search history.

(56) References Cited

U.S. PATENT DOCUMENTS

| | | | | | |
|---|---|---|---|---|---|
| 3,127,993 | A * | 4/1964 | Phipps | B65D 73/0057 | 206/484 |
| 4,512,474 | A * | 4/1985 | Harding | B65D 75/225 | 206/461 |
| 4,732,273 | A * | 3/1988 | DeMarco | B65D 75/225 | 206/470 |
| 7,497,348 | B2 * | 3/2009 | Johnson | B01F 9/0001 | 220/4.22 |
| 8,714,387 | B2 * | 5/2014 | Davidson | B65D 81/264 | 220/4.21 |
| 10,077,147 | B2 * | 9/2018 | Stone | B65D 75/566 | |
| 2004/0262187 | A1 * | 12/2004 | Schauer | B65D 25/10 | 206/521 |
| 2012/0193353 | A1 * | 8/2012 | Cronin | A45C 13/005 | 220/4.22 |
| 2013/0313155 | A1 * | 11/2013 | Ha | B65D 85/00 | 206/525 |

* cited by examiner

*Primary Examiner* — Rafael A Ortiz
(74) *Attorney, Agent, or Firm* — William S. Parks

(57) ABSTRACT

A carrying case configured for a portable cordless fan is disclosed herein. Such a disclosed carrying case allows for storage and transport of the subject cordless fan with a provision of certain recess structures at specific locations therein for placement of the components of such a fan with facilitated storage, closure, and transport, as well as opening and access thereto. Such a carrying case is hinged for opening and closing with locking means leading from one top edge to the opposite top edge. Such a hinged mechanism and closing mechanisms allows for proper stowage of removable fan blades without potential for such blades escaping or falling out upon opening of the case itself after transport. A remote and power module are also provided with the subject fan with proper retaining recesses within the internal portion of the case, as well.

3 Claims, 3 Drawing Sheets

PORTABLE CORDLESS FAN CARRYING CASE

FIELD OF THE INVENTION

The disclosure pertains to a carrying case configured for a portable cordless fan. Such a disclosed carrying case allows for storage and transport of the subject cordless fan with a provision of certain recess structures at specific locations therein for placement of the components of such a fan with facilitated storage, closure, and transport, as well as opening and access thereto. Such a carrying case is hinged for opening and closing with locking means leading from one top edge to the opposite top edge. Such a hinged mechanism and closing mechanisms allows for proper stowage of removable fan blades without potential for such blades escaping or falling out upon opening of the case itself after transport. A remote and power module are also provided with the subject fan with proper retaining recesses within the internal portion of the case, as well.

BACKGROUND OF THE PRIOR ART

Although portable carrying cases have been provided for various types of tools, devices, etc., in the past to store and transport such articles as needed, there have been lacking specific containers for such purposes for portable cordless fans. In particular, portable fans are typically ground-standing types that are provided with vertically oriented fan blades that are permanently attached (or at least designed to remain in place during transport). Other fans, such as oscillating fans, for example, likewise include vertically oriented fan blades and, like ground-standing fans, actually include cages or like structures to protect users and passersby from injury due to such fan blade rotation. In terms of fans that are positioned from a height (such as a ceiling fan, for example), portable carrying cases are nonexistent, particularly as it concerns fans that are configured with removable fan blades during such storage and transport. There have been certain fans that may stow blades through a hinged connection allowing for such blades to fold together to a certain position in relation to the remaining components thereof; however, the provision of a carrying case for purely cordless fan device with horizontally oriented fan blades (for such rotation at a height, thereby more difficult for human contact therewith during operation) that are covered by a protecting cage (or grid, or any like structure to prevent or at least reduce the chance of human contact with such rotating blades) is lacking. Furthermore, the provision of any carrying case for such a horizontally oriented rotation fan device that is properly configured for the placement of removable fan blades with the entirety of the remaining portable fan structure has yet to be disclosed within this commercial area.

SUMMARY OF THE DISCLOSURE

It is proposed that the storage and transport case associated with such a specific type of portable fan comprise a hard-plastic shell structure with different opposing sides and with a mid-point hinge (living or other type) on one shared edge to permit the shell to be opened and closed on demand. A first opposing side would comprise a recess with a first larger concave structure, a second smaller concave structure, and a connecting recess from the first concave recess structure to the second concave structure. A second opposing side of the case would thus include a similarly sized first larger concave structure as well as a similarly sized smaller concave structure as the first opposing side. However, such second opposing side would also include a rectangular recess of a depth and length and width to allow for placement of removable fan blades as well as space for a similar connecting recess area as in the first opposing side between the first and second concave structures. Such a large concave recess structure on both opposing case sides allows for a cylindrically shaped motor component of the subject portable fan to be placed for storage and transport. The opposing sides allow for such placement and enclosure thereover upon closing of the shell case around the hinge component and the edges of both opposing sides contacting together with the locking means operated, as well. The smaller concave recess structures of the opposing sides allow for placement of the rotating fan component (being a smaller disc-shaped or small cylindrically shaped component) with the connecting recess structure on both opposing sides allowing for an extending arm (for connection between both the motor and the rotating platform) to reside during storage and transport. Such an arm is cylindrically shaped, as well, but is rod-shaped and thus much smaller in size than either of the motor and rotating platform components. Such an arm is disposed from the exact center of the motor component and leads to the exact center of the rotating platform component, thereby not requiring much space for storage and transport, but a sufficient amount so as to be properly placed without any appreciable or at least damaging contact from any other components or the stored fan blades. The rotating platform is also smaller in terms of not only height as compared to the motor, but also in terms of depth and length. Thus, the recesses required and configured within the disclosed carrying case are provided to snugly encompass the different components therein to ensure no undesirable movement (that may harm or mar the fan components, at least) during transport may occur.

The fan blade storage recess is thus provided as noted above such that the extended arm from the motor component to the rotating platform component actually acts as an obstacle to such fan blade movement during storage and transport. Basically, the rectangular recess is configured such that the fan blades are evenly (or at least substantially evenly) stored within the carrying case with the same (or substantially the same) lengths of such fan blades stored on either side of the fan extended arm when all fan components are stored within the disclosed carrying case. In such a manner, then, the user may simply remove the fan blades from the fan base (the motor/rotating platform/extending arm components that are all permanently attached to one another), ostensibly from the rotating platform, place them together within the rectangular recess, then place the remaining fan components within the proper recesses over the fan blades, close the carry case by bringing the opposing side without the fan blades and fan components placed therein together to meet the top edges of both opposing sides together, and close and lock the case. The portable fan carrying case may then be picked up and moved to any desired location, may be placed in any position, and may be stored as needed until further use is undertaken. The case may then be unlocked, opened with the opposing side housing the fan blades and fan components lying flat, and the fan component removed, the fan blades reconnected in place securely, the stowed connectors at the top of the motor component unstowed and extended for connection with a suitable structure overhead, and then placed on demand for such overhead horizontal oriented fan blade rotation. Such a structure may be a canopy (with, for instance, skeleton arms leading at an incline to an apex adjacent thereto such a fan may be placed for air circulation/cooling purposes).

The cordless capability of such a fan device allows for such portability and utilization at any desired location, certainly. As such, the ability to provide battery rechargeability is provided with such a cordless fan (such as with lithium ion rechargeable batteries, as one possible alternative), particularly with a power module for such a purpose. A separate plug-in charger may be provided and, if desired, may be accorded with a separate recess within the carrying case, particularly in a manner that allows complete and secure placement of such a power module to prevent any movement during storage and transport. The opposing side from such a recess would thus be flat itself and a barrier to any such potential movement during storage and transport. The width, length, and depth, of such a recess would be sufficiently large for placement of such a power module (charger with a cord and plug, as one example), as well. Alternatively, the carrying case may also include an internal plug component that leads from the internal part of the case to a port on the external surface of the case. Such a port may allow for a charger connection to be attached for recharging of the power module itself (that may be integrated within the case) or may allow the internal plug to connect with a port on the fan base for external plug-in outside the carrying case while the fan entirety is stored therein.

Additionally, the portable fan device may also include a remote controller to permit a user the ability to control fan operation and activation (and deactivation) without having to reach overhead for such a purpose. The portable fan may thus include the necessary wireless circuitry for such remote-control activity. As such, the carrying case may also include a separate recess within therein for such a controller to be stored and transported without moving therefrom upon closing of the case itself. Thus, much like the disclosure above regarding the power module recess structure, a sufficiently large size for such placement and storage of a remote control would be desirable, with the opposing side having a flat surface to act as a barrier to remote control movement therefrom during storage and transport. Additionally, the recesses for either or both the power module and remote control may include flexible lower portions therein to allow for retention of either or both articles, as well as possible indentations to allow for a user to grab such articles from such stored recesses.

The carrying case, as noted above, is a hard-plastic shell, preferably, to allow for a sturdy structure to prevent damage internally to the fan components during storage and transport. Additionally, however, the hard plastic should be of a suitable weight to facilitate a user's utilization and carriage of such a structure. Such a portable fan would be roughly from 3 to 7 pounds itself; the carrying case would thus preferably weigh from about 1 to 3 pounds. The plastic to be utilized may be of any type that accords flexibility (such as for a living hinge, as well as recess structures) as well as toughness to protect the fan components therein. Polymers such as high-density polyethylene, linear low density polyethylene, low density polyethylene, polypropylene, polycarbonate, polyacrylate, polystyrene, and the like, would thus may be of potential preference for such a purpose.

Additionally, such a carrying case may include openings within both opposing sides in an area near the top edges of both sides to permit the user a handle to carry the case itself. Such an opening would thus align between both sides in order to provide such a handle when both sides are brought together and locked in place. Such a handle may be of any shape as long as such facilitates gripping by a user and does not tear apart during standard utilization. Thus, the opening (s) may be disposed a distance below the top edges of both sides to permit sufficient amounts of hard plastic to be present for rigidity purposes. The locking means described herein may be integrated hard plastic clips that extend from one opposing side top edge to align with and connect with a properly and complementary shaped extension on the opposing side top edge. Otherwise, such locking means may be metal snaps, magnets, sliding metal fasteners, or other like devices typically utilized in carrying cases.

The closed carrying case may be placed on any of five edges as the bottom edge, and all four side edges thereof will be flat. The top edge with the handle and locking means may be flat to a degree, but may also exhibit inclines from the top edge to a location within the front or back sides (or both) to accommodate for the smaller concave recess structures (for the rotational platform introduction) as well as to reduce the amount of hard plastic needed to allow for such carrying case utilization in total. In any event, the carrying case may be placed on any side (front, back, left, right, bottom, without fear of dislodging or harmful movement of the fan itself inside the case, particularly if the case is properly closed and locked. The case with the portable fan may thus be stored, as noted above, as desired and transported anywhere as needed for utilization on demand.

Accordingly, the disclosure encompasses a carrying case for a portable fan comprising a fan base and removable fan blades, said carrying case comprising i) a first opposing side comprising a left edge, a right edge, a top edge, and a bottom edge, wherein said left edge and said right edge exhibit a mid-point distance between them, wherein said first opposing side includes a first concave recess exhibiting a length, a second concave recess smaller in depth, height, and width in comparison with said first concave recess and exhibiting a length, and a connecting recess between said first and second concave recess, and wherein each of said first and second concave recesses exhibits a mid-point in length that is the same location as the mid-point distance between said left and right edges; ii) a second opposing side comprising a left edge, a right edge, a top edge, and a bottom edge, wherein said left edge and said right edge exhibit a mid-point distance between them, wherein said second opposing side includes a first concave recess and a second concave recess smaller in depth, height, and width in comparison with said first concave recess, wherein said second opposing side further includes a rectangular recess between said first and second concave recesses, and wherein each of said first and second concave recesses exhibits a mid-point in length that is the same location as the mid-point distance between said left and right edges; iii) a hinge present as a connection between said bottom edges of said first and second opposing sides; iv) aligned openings within said opposing sides to provide a handle upon alignment and closure of said carrying case; and iv) locking means to securely close said carrying case; wherein said left edges, eight edges, and top edges of both of said first and second opposing sides are aligned to contact each similarly termed side upon movement of one of said opposing sides around said bottom edge hinge until said top edges contact one another. The further inclusion of extra recesses within the first or second opposing sides is also encompassed herein, as well as a method of storing and transporting a portable cordless fan with removable fan blades utilizing such a carrying case.

The mid-point distance between the left and right edges of each opposing side is important in relation to the recesses for fan base component placement in that the mid-point location of each recess aligns with such a mid-point distance between left and right edges to accord a proper and even balance of the portable fan as stored and transported. With a skewed or at least uneven alignment in that respect, the carrying case would not exhibit a proper balance for the user and difficulties with carrying may occur. Thus, the substantial even balance accorded the user is at least to a degree provided by such proper recess configurations in relation to the portable fan structure.

BRIEF DESCRIPTION OF THE DRAWINGS

The disclosure will be better understood and further advantages thereof will become more apparent from the ensuing detailed description of a preferred embodiment taken in conjunction with the drawings, in which.

DESCRIPTION OF THE PREFERRED EMBODIMENTS

The following descriptions and examples are merely representations of potential embodiments of the present disclosure. The scope of such a disclosure and the breadth thereof in terms of claims following below would be well understood by the ordinarily skilled artisan within this area.

Figure 1:
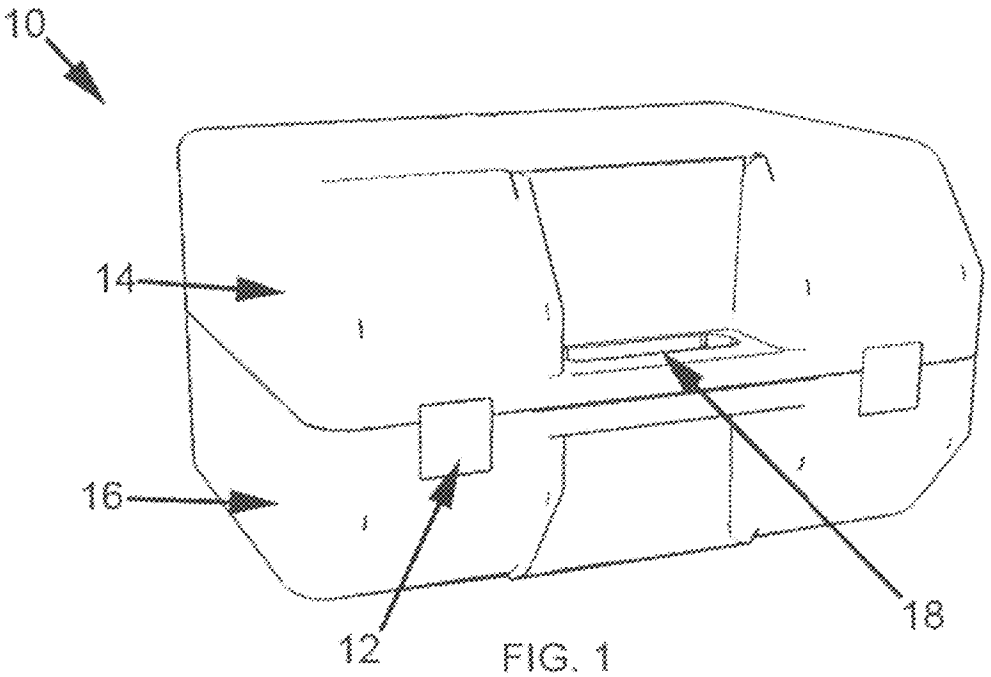
FIG. 1 is a side perspective view of one potential embodiment of a disclosed carrying case for a portable cordless fan in closed state.

FIG. 1 shows a side perspective view of one possible embodiment of the disclosed portable cordless fan carrying case 10 in closed state. Locking clips 12 provide secure closure of the case 10 having a first opposing side 14 and a second opposing side 16. A handle 18 made from aligned openings in both opposing sides allows for facilitated transport by hand.

Figure 2:
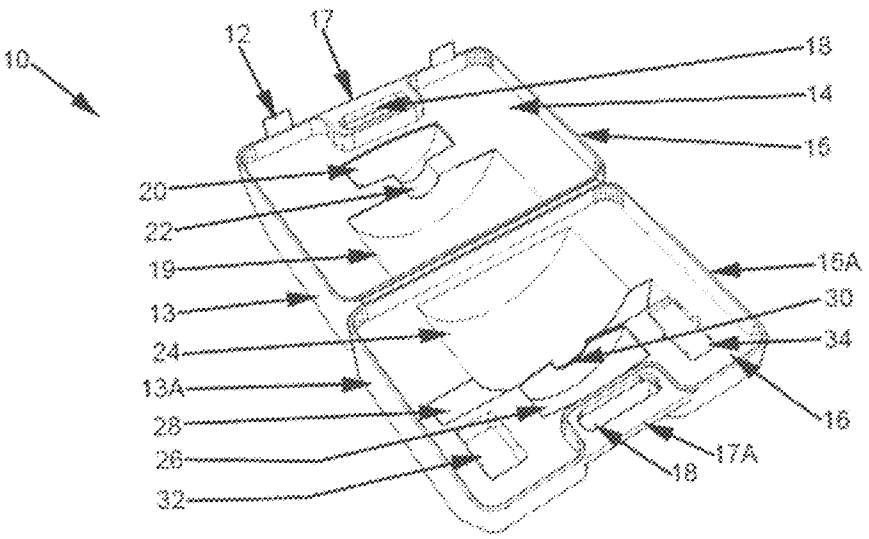
FIG. 2 is an aerial perspective view of the carry case embodiment of FIG. 1 in opened state.

FIG. 2 shows the same carrying case 10 in open state with the locking clips 12 unattached. The first opposing side 14 and a right edge 13 and left edge 15 with a mid-point distance 17 in between. The first opposing side 14 further includes a first concave recess 19, a second smaller concave recess 20 above the first 19 and a connecting recess 22 between the two recesses 19, 20. The mid-point distance 17 of the left and right edges 13, 14 is also the mid-point location for the recesses 19, 20, 22. The second opposing side 16 also has a left edge 13A and right edge 15A with a mid-point distance 17A between the two. A first concave recess 24 is shown with a second smaller recess 26, both with mid-point locations the same as the left edge/right edge mid-point 17A. A rectangular recess 28 is present within the second opposing side 16 with a smaller connecting recess 30 present adjacent thereto the rectangular recess 28. Also present are a power module recess 32 and a remote control recess 34. The first opposing side 14 does not have corresponding recess structures for the rectangular recess 28 or two other recesses 32, 34.

Figure 3:
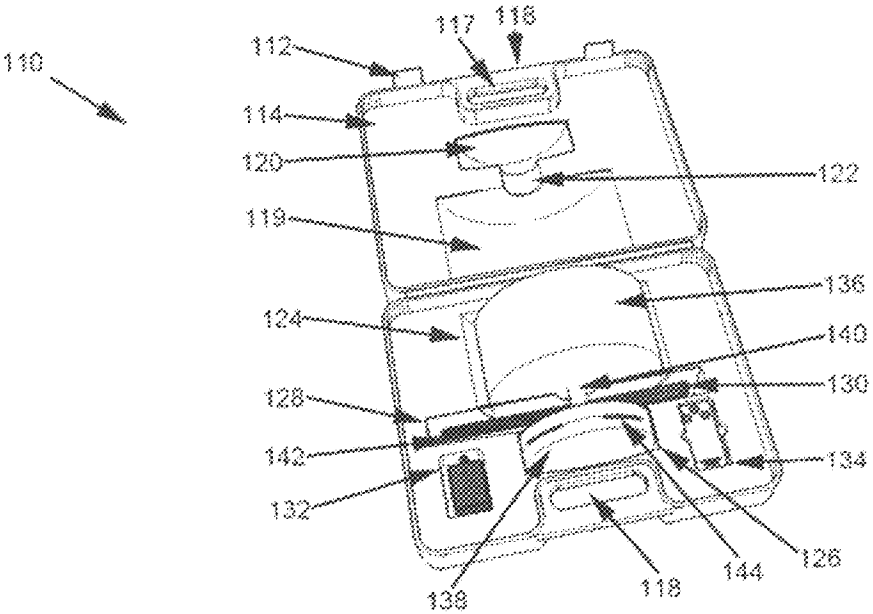
FIG. 3 is an aerial perspective view of a potential embodiment of a portable cordless fan carrying case with fan placed therein.

FIG. 3 thus shows an embodiment of an open carrying case 110 with the placement of removed fan blades 142 within the rectangular recess 128 of the second opposing side 116, a fan motor component 136 within the first concave recess 124, a fan rotating platform 138 having openings for fan blade placement and attachment 144 within the second concave recess 126, and a connecting arm component 140 resting within the connecting recess 130. Also, there are present a power module 132 and a remote control 134 within those recesses. The first opposing side 114 thus has the complementary recesses 119, 120, 122 for the full fan base (motor component 136, rotating platform 138, and connecting arm 132 for secure enclosure of the entire fan assembly (blades and fan base, as well as power module and remote control). The closed case (as in FIG. 1) thus retains the entire fan assembly for storage and transport as desired. A safe manner of enclosing, locking, storing, and transporting such a portable cordless fan device is thus provided with an evenly balanced structure that is protective and easy to carry and store.

The foregoing relates to a preferred exemplary embodiment of the invention, it being understood that other variants and embodiments thereof are possible within the spirit and scope of the invention, the latter being defined by the appended claims.

What I claim is:

1. A carrying case for a portable fan comprising a fan base and removable fan blades, said carrying case comprising i) a first opposing side comprising a left edge, a right edge, a top edge, and a bottom edge, wherein said left edge and said right edge exhibit a mid-point distance between them, wherein said first opposing side includes a first concave recess exhibiting a length, a second concave recess smaller in depth, height, and width in comparison with said first concave recess and exhibiting a length, and a connecting recess between said first and second concave recess, and wherein each of said first and second concave recesses exhibits a mid-point in length that is the same location as the mid-point distance between said left and right edges; ii) a second opposing side comprising a left edge, a right edge, a top edge, and a bottom edge, wherein said left edge and said right edge exhibit a mid-point distance between them, wherein said second opposing side includes a first concave recess and a second concave recess smaller in depth, height, and width in comparison with said first concave recess, wherein said second opposing side further includes a rectangular recess between said first and second concave recesses of a depth, length, and width to allow for placement of said removable fan blades, and a connecting recess between said rectangular recess and said second concave recess, wherein said connecting recess is of a smaller size than said connecting recess present within said flat first opposing side, wherein said rectangular recess within said second opposing side does not have a corresponding rectangular recess within said first opposing side of said carrying case, and wherein each of said first and second concave recesses exhibits a mid-point in length that is the same location as the mid-point distance between said left and right edges; iii) a hinge present as a connection between said bottom edges of said first and second opposing sides; iv) aligned openings within said opposing sides to provide a handle upon alignment and closure of said carrying case; and iv) locking means to securely close said carrying case; wherein said left edges, right edges, and top edges of both of said first and second opposing sides are aligned to contact each similarly termed side upon movement of one of said opposing sides around said bottom edge hinge until said top edges contact one another.

2. The carrying case of claim 1 further comprising at least one other recess within said second opposing side.

3. A method of storing and transporting a portable cordless fan, wherein said fan comprises i) a fan base having a motor component, ii) a rotating platform component, iii) a connecting arm between said motor component and said rotating platform component, and iv) removable fan blades, wherein said fan blades removably attach to said rotating platform component during utilization thereof; said method comprising the steps of:

a) providing said portable cordless fan with said fan blades removed from said rotating platform component of said fan base;

b) providing and opening said carrying case of claim 1;

c) placing said portable cordless fan within said open carrying case with said removed fan blades within said rectangular recess of said second opposing side, followed by the placement of said fan base with said motor component thereof placed within said first concave recess of said second opposing side and said rotational platform component placed within said second concave recess of said second opposing side;

d) closing said carrying case by rotating said first opposing side around said bottom edge hinge until said top edges of said first and second opposing sides contact together; and e) locking said carrying case through said locking means on said top edges of said first and second opposing sides.

* * * * *